US005335869A

United States Patent [19]

Yamaguchi et al.

[11] Patent Number: 5,335,869

[45] Date of Patent: Aug. 9, 1994

[54] CUT-WEB TAIL EDGE HOLDING MEANS FOR WEB WINDING APPARATUS

[75] Inventors: Chotaro Yamaguchi; Katsuaki Shirakawa, both of Kagawaken, Japan

[73] Assignee: Kawanoe Zoki Co., Ltd., Ehimeken, Japan

[21] Appl. No.: 53,178

[22] Filed: Apr. 26, 1993

Related U.S. Application Data

[63] Continuation of Ser. No. 727,658, Jul. 9, 1991, abandoned.

[30] Foreign Application Priority Data

Jul. 25, 1990 [JP] Japan ..... 2-197382

[51] Int. Cl.[5] ..... B65H 19/26

[52] U.S. Cl. ..... 242/526; 242/526.1

[58] Field of Search ..... 242/56 R, 56 A, 56 B, 242/56.8, 66; 83/116, 151, 154

[56] References Cited

U.S. PATENT DOCUMENTS

| | | | |
|---|---|---|---|
| Re. 28,353 | 3/1975 | Nystrand et al. | 242/56 A |
| 2,138,406 | 11/1938 | Huck | 83/151 |
| 3,179,348 | 4/1965 | Nystrand et al. | 242/56 A |
| 3,369,766 | 2/1968 | Herman | 242/56 A |
| 3,549,097 | 12/1970 | Seigh | 242/56 A |
| 3,552,670 | 1/1971 | Herman et al. | 242/56 A |
| 3,567,552 | 3/1971 | Heuff et al. | 242/56 R |
| 4,487,377 | 12/1984 | Perini | 242/56.8 |
| 4,919,351 | 4/1990 | McNeil | 242/568 X |

FOREIGN PATENT DOCUMENTS

| | | | |
|---|---|---|---|
| 41543 | 11/1974 | Japan | B65H 19/22 |
| 22186 | 3/1983 | Japan | B65H 19/22 |

*Primary Examiner*—John M. Jillions

[57] ABSTRACT

A web winding apparatus including a main winding drum and a web separator roll which are operatively interconnected to rotate in synchronism. The drum has a channel in the surface thereof. The roll has a cutter blade projecting from the surface thereof. At selected times during synchronous rotation of the drum and the roll the cutter blade is forced into the channel to move the web into the channel and tear the web in the channel. A hook blade having a large number of hooks is mounted at the fore side of the channel. Edges of the hooks are arranged side by side in a rearward looking pattern in the direction of rotation of the drum. Therefore, when the cutter blade plunges into the channel and the web is torn in the channel, the tail edge of the separated web is caught by the hook and held against the surface of the drum.

2 Claims, 6 Drawing Sheets

CUT-WEB TAIL EDGE HOLDING MEANS FOR WEB WINDING APPARATUS

This application is a continuation of application Ser. No. 727,658, filed Jul. 9, 1991, now abandoned.

BACKGROUND OF THE INVENTION

1. Field of the Invention

The present invention relates to a cut-web tail edge holding means for web winding apparatus.

2. Description of the Prior Art

Conventional web rewinders for rewinding webs of sheet material, such as paper, from big rolls into smaller rolls includes a web separating (cutting) device for cutting a continuous web to a desired length, of the type as described in, for example, U.S. Pat. Nos. 3,552,670 and 4,487,377.

Such known web winding apparatus, as FIGS. 8 and 9 show (which drawings are based on like drawings given in U.S. Pat. No. 4,487,377), has a main winding drum 35 and a web separator roll 40 which are operatively interconnected so as for them to rotate in synchronism, the main winding drum 35 having a channel 42 in the surface thereof, the web separator roll 40 having a web separator device 41 projecting from the surface thereof, the channel 42 and the web separator device 41 being so formed in the main winding drum 35 and the web separator roll 40 respectively that at selected times during synchronous rotation of the main winding drum 35 and the web separator roll 40 the web separator device 41 is forced into the channel 42, the web separator device 41 having a rigid member 43 which forces the web 31 into the channel 42 such that when the rigid member 43 is forced into the channel 42, the web separator device 41 will move the web 31 into the channel 42 a distance in excess of the stretch and tensile characteristics of the web so as to tear the web in the channel 42.

In web rewinders having such a web separator device, once a continuous web is severed (cut), it is impracticable to move the leading edge 31*a* of the severed web 31 to a position at which the leading edge 31*a* is to be put in contact with a core 38 for a next roll of web, because the leading edge 31*a* and trailing or tail edge 31*b* of the severed web 31 are already separated from the surface of the drum 35 against which they had been integrally held; it is also impracticable to keep the tail edge 31*b* of the severed web 31 from coming in contact with the surface of the core 38 which is usually coated with an adhesive.

In order to avoid such inconvenience, therefore, it is usual practice with apparatus of the above mentioned type that the main winding drum 35 is equipped with a vacuum arrangement so that even after web 31 severance has taken place, both the leading edge 31*a* and the tail edge 31*b* of the web are held against the main winding drum 35 at locations adjacent the channel 42 and over a certain distance of rotation.

The main winding drum 35 is formed in its surface with suction ports 46, 50 which are arranged at opposite sides of the channel 42 and in circumferentially spaced apart relation therewith. According to this arrangement, the leading edge 31*a* and tail edge 31*b* of the severed web can be held in suction by these suction ports 46, 50, whereby they may be held against the surface of the main winding drum 35 over a specified distance of drum rotation. The tail edge 31*b* of the severed web may be held in abutment against the surface of the main winding drum 35 so as for it not come in contact with the adhesive coated surface of the core 38.

In the prior art apparatus, in order to enable the tail edge 31*b* of the severed web to be held in contact with the surface of the main winding drum 35 until it passes a predetermined position and also enable the leading edge 31*a* of the severed web to be held against the surface of the main winding drum 35 until it reaches a predetermined position, and then to enable both the leading and tail edges 31*a*, 31*b* to be disengaged from the drum surface, as FIGS. 8 and 9 show, the interior of the main winding drum 35 is defined into two chambers, namely, a vacuum chamber 53 and an atmospheric chamber 54 by two partition walls 51, 52, the vacuum chamber 53 being constantly in communication with a vacuum source, the atmospheric chamber 54 being not connected to the vacuum source. Means are provided at the partition walls 51, 52 for starting and stopping vacuum action for web suction by the suction ports 46, 50. Such arrangement involves considerable elaborateness in construction. In particular, spacious interior of the main winding drum 35, a rotating body, must be defined into two chambers by partition walls 51, 52, non-rotating stationary members, which must be firmly fixed in position so as not to rotate and airtightly held at their ends in sliding contact with the inner periphery of the main winding drum 35.

This drawback may be overcome by, for example, arranging that in the interior of the main winding drum 35 a vacuum chamber is defined by a partition wall rigidly fixed to the inner surface of the drum 35, with suction ports 46, 50 so formed as to open into the vacuum chamber, and that the vacuum chamber is adapted to be connected through a valve plate (like a timing plate for an axial piston diagonal plate type hydraulic motor), mounted to a side of the main winding drum 35, to the vacuum source only for a limited part of one rotation (not shown). In this case, however, there must be two vacuum chambers which are rotatable integrally with the main winding drum 35, or otherwise it is impracticable to arrange that two suction ports 46, 50 located at different phases of rotation can effectively be released at a specified phase of rotation of the drum 35 from the vacuum source.

Furthermore, such vacuum arrangement involves other problems, such as high power consumption and high noise due to vacuum air (which makes a source of noise). Another problem is that the suction port 50 with which the tail edge 31*b* of the severed web comes in contact is liable to dust deposition, which requires frequent cleaning.

SUMMARY OF THE INVENTION

In view of these inherent disadvantages of such vacuum arrangement, therefore, it is a primary object of the present invention to provide a novel web tail-edge holding device which enables a cut-web tail edge to be held against the surface of a main winding drum for a specified part of one rotation of the drum, without using any vacuum device.

In order to accomplish the above object, the cut-web tail edge holding device for a web winding apparatus in accordance with the invention is constructed as follows.

In a web winding apparatus including a main winding drum 5 and a web separator roll 10 which are operatively interconnected so as for them to rotate in synchronism, the main winding drum 5 having a channel 12 in the surface thereof, the web separator roll 10 having web separator means 11 projecting from the surface thereof, the channel 12 and the web separator means 11 being so formed in the main winding drum 5 and the web separator roll 10 respectively that at selected times during synchronous rotation of the main winding drum 5 and the separator roll 10 the web separator means 11 is forced into the channel 12, the web separator means 11 having a rigid member 13 which forces the web 1 into the channel 12 such that when the rigid member 13 is forced into the channel 12, the web separator means 11 will move the web 1 into the channel 12 a distance in excess of the stretch and tensile limits of the web so as to tear the web 1 in the channel 12; a separated-web tail edge holding device comprising means for holding the tail edge 1*b* of the web 1 adjacent the channel 12 and in contact with the surface of the main winding drum 5 after the web separation takes place, the tail edge holding means consisting of a hook blade assembly 20 attached to the surface of the main winding drum 5 at the fore side of the channel 12 in the direction of rotation of the main winding drum 5, the hook blade assembly 20 having a multiplicity of hooks 22 with their respective edges arranged side by side along the edge of the channel 12 and rearwardly of the direction of rotation of the main winding drum 5.

In the web tail edge holding device, constructed as described above, at selected times during synchronous rotation of the main winding drum 5 and web separator roll 10 of the web winding apparatus, the web separator means 11 is forced into the channel 12, so that when the rigid member 13 is forced into the channel 12 (see FIGS. 5 and 6), web 1 is forced into the channel 12 a distance in excess of the stretch and tensile characteristics of the web and is severed in such fashion that it is torn by the rigid member 13 of the web separator means 11 in the channel 12. Furthermore, the main feature of the web winding apparatus according to the invention is such that a hook blade assembly 20 is attached to the surface of the main winding drum 5 at the fore side of the channel 12 in the direction of rotation of the drum. The hook blade assembly 20 has a multiplicity of hooks 22 with their respective edges arranged side by side along the edge of the channel 12 and rearwardly of the direction of the drum 5. Therefore, when the web 1 is forced by the rigid member 13 of the web separator means 11 into the channel 12, the web 1 is pressed at its portion contacting the edge of the channel 12 against the edges of the hooks 22 arranged side by side along the edge of the channel 12 before the web 1 is separated by the web separator means 11 (FIG. 5), with the result that the edges of the hooks 22 are forced into the web 1. Thus, when the web 1 is forced into the channel 12 a distance in excess of the stretch and tensile limits of web and is separated by the web separator means 11 (FIG. 6), the tail edge 1*b* of the separated web 1 has already been caught in by the multiplicity of hooks 22 arranged side by side along the edge of the channel 12 and under the tensile force which had previously been acting on the tail edge 1*b* side of the web 1.

Therefore, the tail edge 1*b* of the web 1 is allowed to pass the clearance between the main winding drum 5 and a core 8 as it is held against the surface of the drum 5, without contacting the adhesive coated surface of the core 8 (FIG. 7).

By the time when the tail edge 1*b* of the web 1 has passed the clearance between the main winding drum 5 and the core 8 without contacting the core 8, the web 1 is already being wound onto the core 8 which is rotating in a direction opposite the direction of rotation of the main winding drum 5.

Therefore, at such time that the main winding drum 5 has made a further suitable quantity of rotation, when the tail edge 1*b* of the web 1 moves further away from the drum 5, the tail edge is subject to a force acting in a direction away from the hooks 22 and is disengaged from the hooks 22.

The web-tail edge holding device of the invention eliminates use of such vacuum arrangement as has been employed in the prior art apparatus and utilizes only the separation pressure to be applied by the web separator on the web. Briefly, the device is so designed that the tail edge of the web to be separated is hooked by a set of hooks, and only by this hooking action the web tail edge is held against the surface of the main winding drum over a desired quantity of drum rotation. Therefore, the invention eliminates the cost of power for such vacuum arrangement as has hitherto been required in the operation of prior art rewinders and, in particular, for holding web tail edge against the main winding drum. Thus, the problem of noise arising from the use of the vacuum arrangement can be eliminated.

Since the web tail edge holding device of the invention does not use vacuum, the trouble of cleaning web-tail edge suction ports for removal of paper dust deposits on the suction ports, as has hitherto been frequently required with the prior art arrangement, is eliminated. This affords ease of maintenance. Furthermore, the device of the invention makes it possible to turn the main winding drum while holding web tail edge more positively than the vacuum arrangement, and therefore it is possible to operate web rewinders at higher speeds than in the case where the prior art vacuum system is employed.

BRIEF DESCRIPTION OF THE DRAWINGS

FIG. 1 is a side view showing a schematic arrangement of the web winding apparatus;

FIG. 2 is a fragmentary vertical sectional view showing web separator means and relevant portions of the web tail edge holding device;

FIG. 3 is a rear view of a hook blade assembly;

FIG. 4 is a section taken on line IV—IV in FIG. 3; and

FIGS. 5 to 7 are explanatory views showing in time sequence the operation of web cutting means and of the web tail edge holding device;

DESCRIPTION OF THE PREFERRED EMBODIMENT

One embodiment of the invention will now be described with reference to the accompanying drawings (FIGS. 1 through 7).

Figure 1:
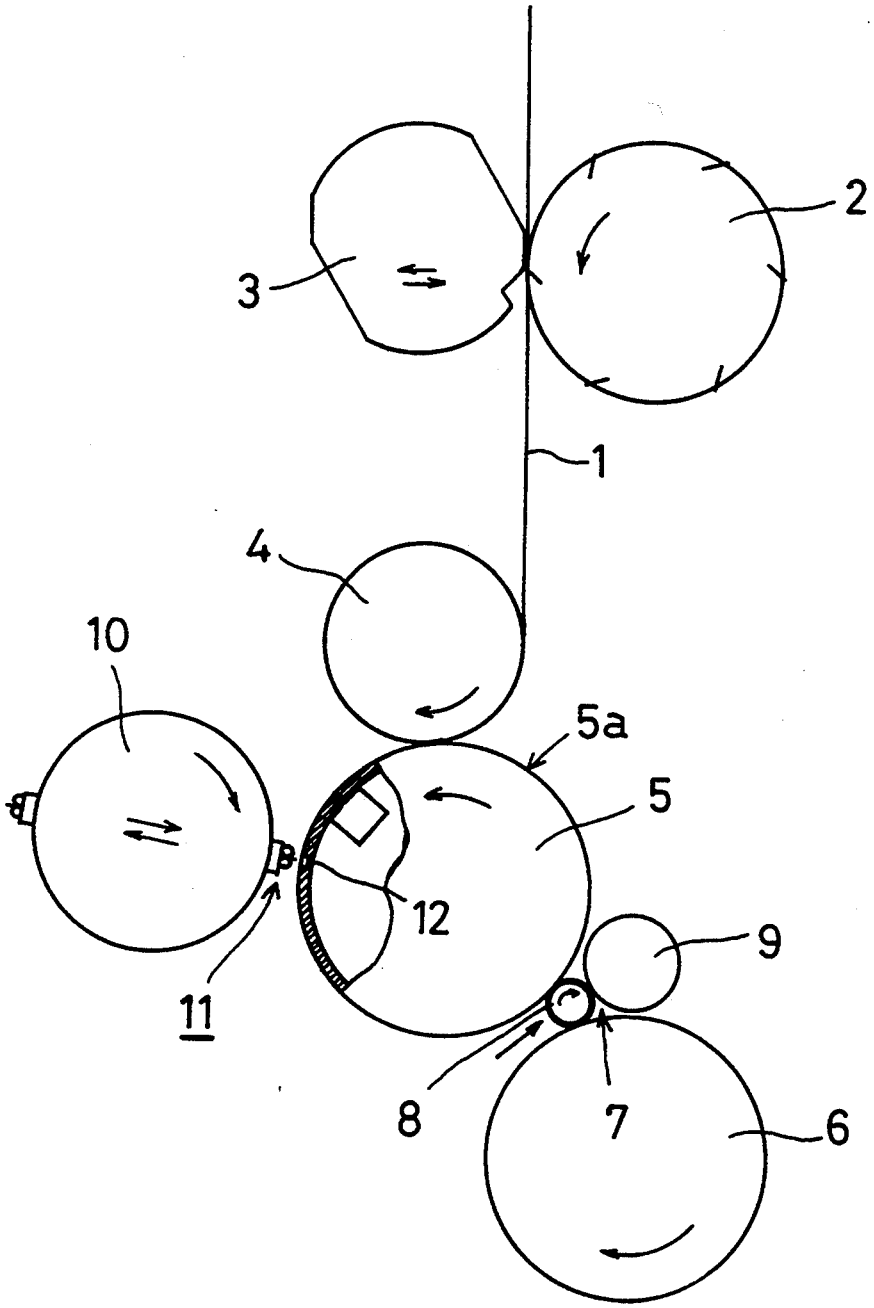
FIGS. 1 to 7 illustrate one embodiment of the separated-web tail edge holding device for web winding apparatus according to the present invention. In these drawings.
Figure 2:
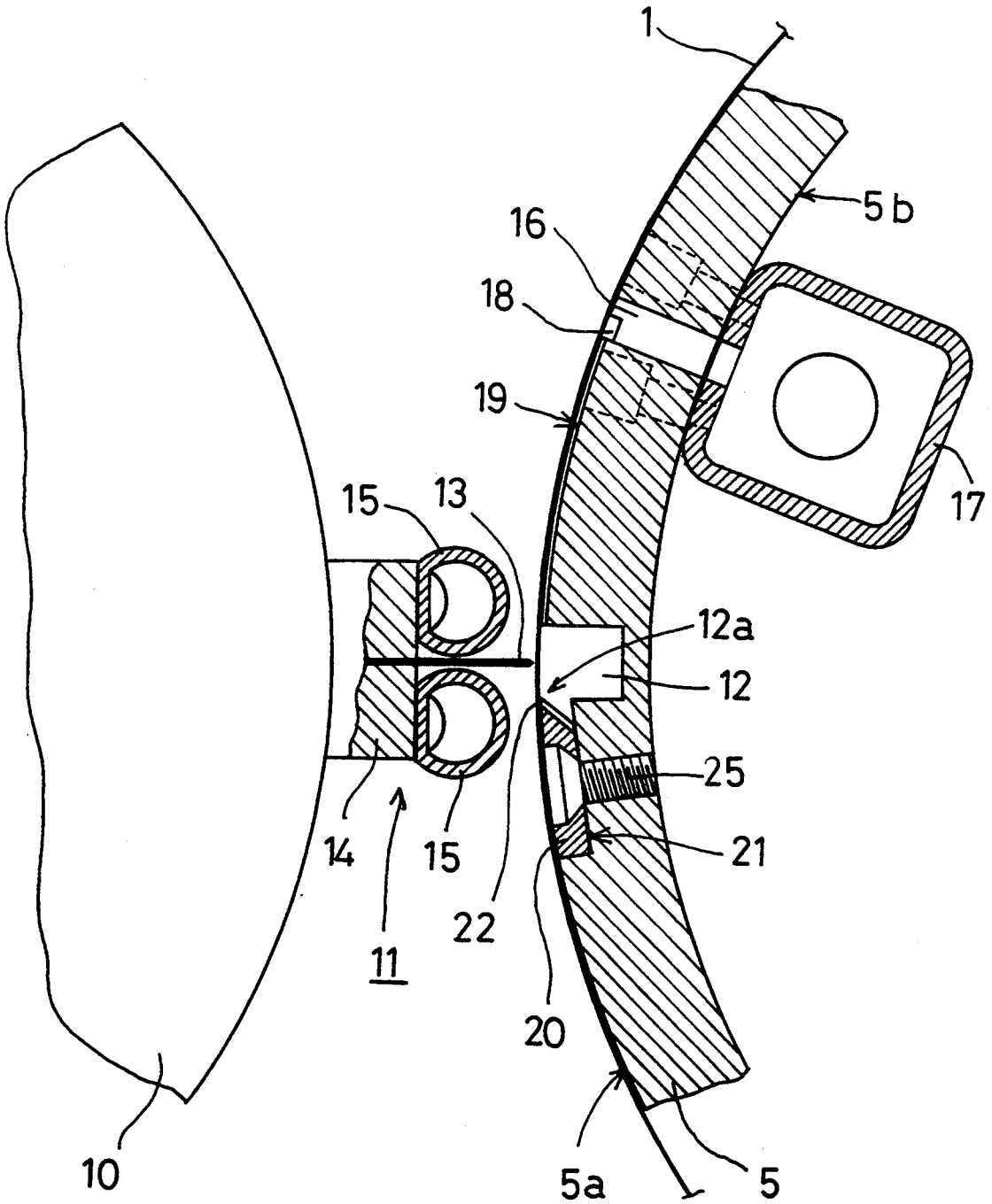

A web winding apparatus is shown in FIGS. 1 and 2, in which a web 1 which has passed between a perforation roll 2 and an anvil roll 3 is wound on a main winding drum 5 via a feed roll 4, and the leading end of the web 1 on the drum 5 is then wound on a core 8 which has been fed into a winding space 7 passing the gap between the drum 5 and a subsidiary winding drum 6. The winding space 7 is defined by the main and subsidiary winding drums 5, 6 and a nip roll 9. Winding is performed until a log of a desired diameter is obtained.

The perforation roll 2 and anvil roll 3 disposed prior to the feed roll 4 makes a perforation forming device combination. When the anvil roll 3 is moved close to the operative position as shown, equally spaced perforations can be formed in the web 1. When the anvil roll 3 is moved away from the perforation roll 2 to an inoperative position (not shown), no perforation is formed in the web 1.

When a log has been formed to a desired diameter, the log is severed by a web separator 11 on a web separator roll 10 disposed in opposed relation to the main winding drum 5.

The main winding drum 5 has a channel 12 formed along a line normal to the surface of the drum 5, and the web separator roll 10 has a web separator 11 attached to its surface and having a cutter blade 13 projecting along a line normal to the surface of the roll 10. When the web separator roll 10, which is in synchronous rotation with the main winding drum 5, is displaced toward the main winding drum 5 and at same phase as shown in FIG. 1, the cutter blade 13 having a saw tooth-like edge (FIG. 2) is forced into the channel 12 as shown in FIGS. 5 and 6, so that the web 1 wound on the surface of the main winding drum 5 is forced into the channel 12 a distance in excess of the stretch and tensile limits of the web 1 and is severed by the edge of the cutter blade 13 in the channel 12.

Figure 5:
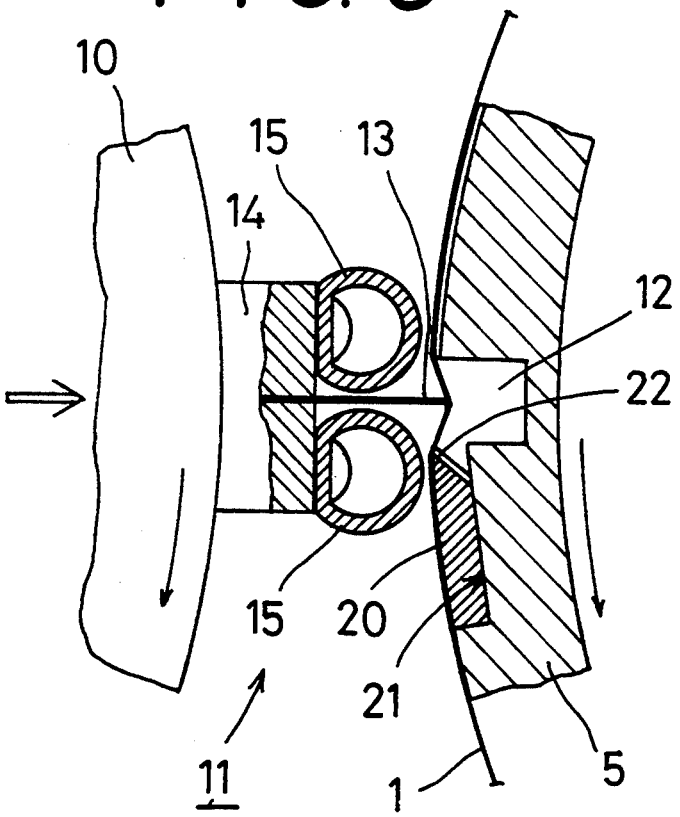
Figure 6:
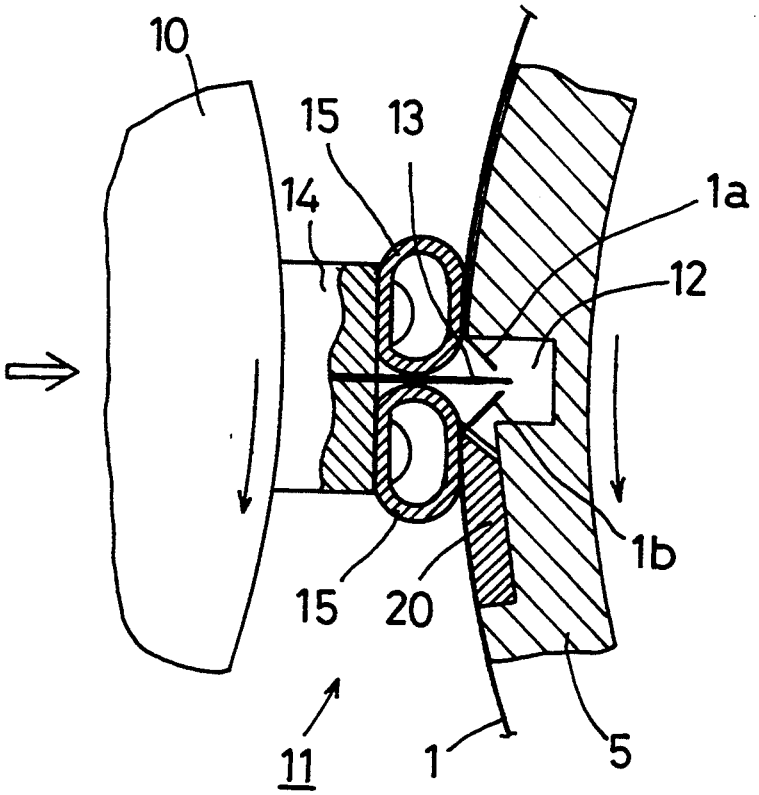
Figure 7:
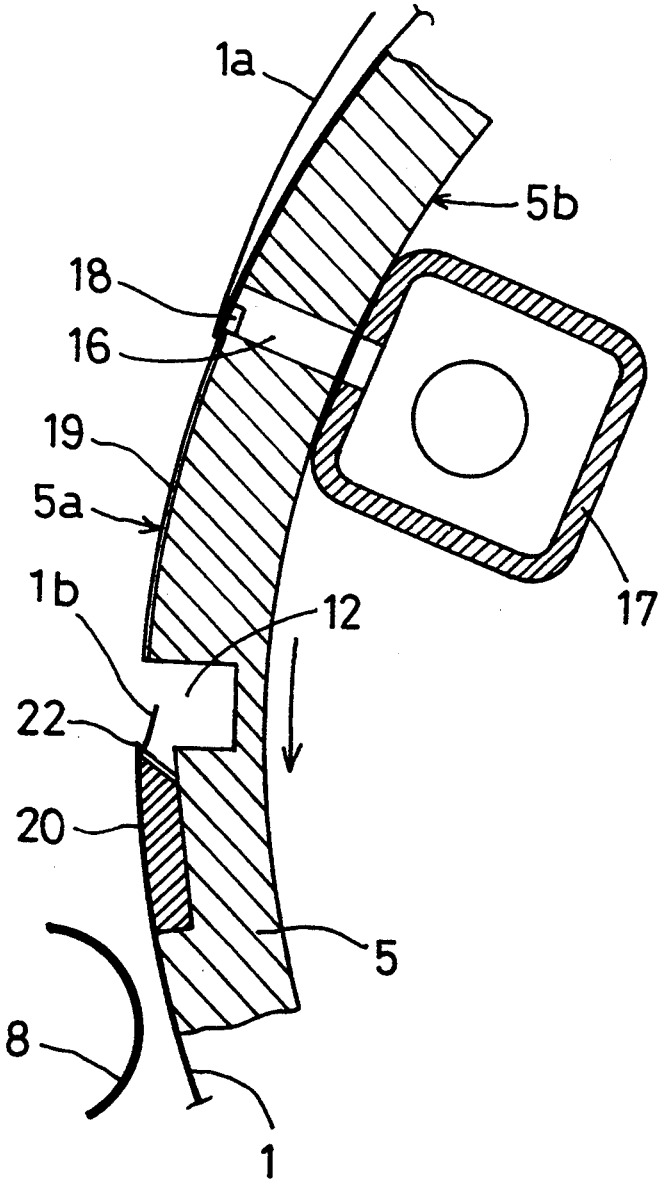
Figure 8:
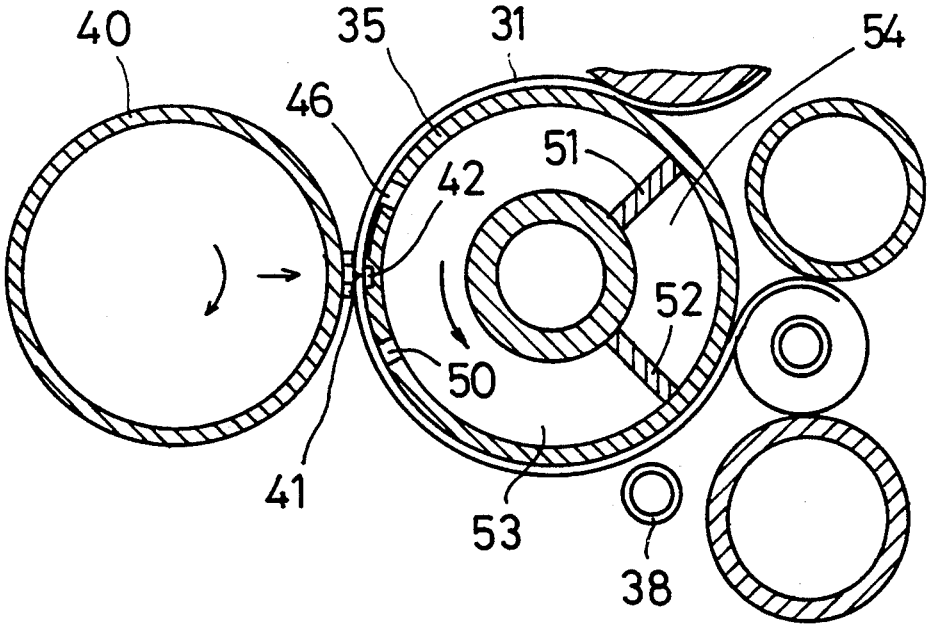
FIG. 8 PRIOR ART
FIGS. 8 and 9 are explanatory views showing in time sequence the operation of the prior art web tail edge holding device.
Figure 9:
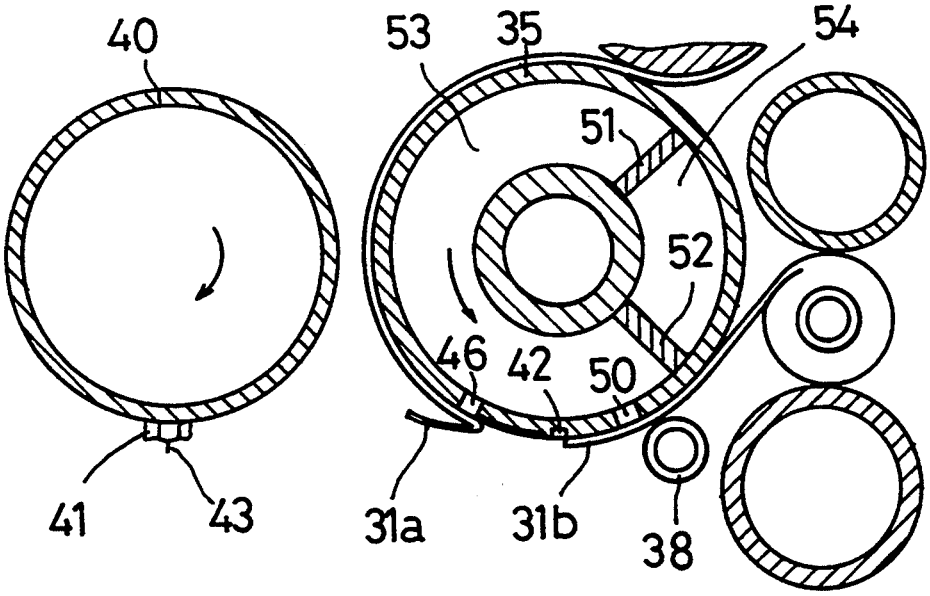
FIG. 9 PRIOR ART

In FIGS. 2, 5, and 6, reference numeral 14 designates a base for the web separator 11 attached to the surface of the web separator roll 10, on which base 14 the cutter blade 13 is removably mounted and on which a pair of web pressers 15, 15 comprised of natural rubber pipes are mounted across the cutter blade 13.

On the surface 5*a* of the main winding drum 5 there are formed a large number of suction holes 16 arranged in a row at the rear side of the channel 12 in the direction of rotation of the drum 5 and spaced apart from the channel 12, which suction holes 16 are open through the surface 5*a* of the drum 5. The suction holes 16 are adapted to be connected to the suction source not shown through a square-pipe duct 17 mounted to the inner surface 5*b* of the main winding drum 5, and through a timing plate (valve plate) not shown, only when the main winding drum 5 is at a specified rotation phase.

In FIG. 2, reference numeral 18 designates a suction channel interconnecting the row of suction holes 16 in the surface 5*a* of the main winding drum 5; and 19 designates a circumferential channel formed in the surface 5*a* of the main winding drum 5 which is designed to prevent the circumferentially flutedly coated adhesive on the surface of the core 8 from being transferred onto the exposed surface 5*a* of the main winding drum 5, after separation of the web 1 has taken place and when the surface 5*a* of the main winding drum 5 between the channel 12 and the suction channel 18 has come into contact with the core 8 for winding the leading edge of the web 1.

Figure 3:
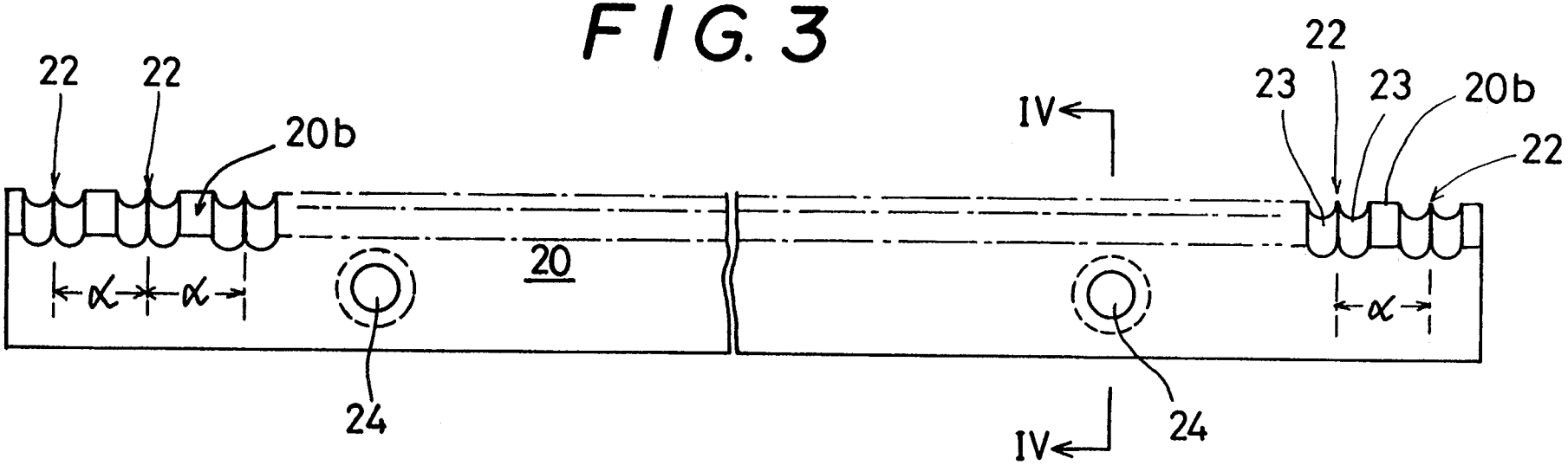
Figure 4:
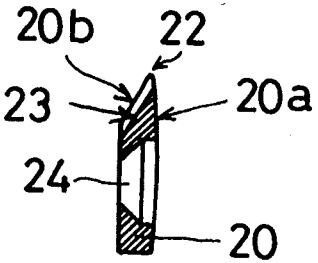

In order to enable the tail edge 1*b* of the web 1 to be properly retained on the main winding drum 5 adjacent the channel 12 after separation of the web 1 by the web separator (severance) has taken place, a hook blade 20 as shown in FIGS. 3 and 4 is arranged on the surface 5*a* of the main winding drum 5 along fore side edge 12*a* of the channel 12 in the direction of rotation of the main winding drum 5.

In the surface 5*a* of the main drum winding drum 5 extending along the fore-side edge 12*a* of the channel 12 and in continuation to the channel 12 there is formed a recess 21 in which the hook blade 20 is mounted. The hook blade 20 in the present embodiment has an arcuate surface 20*a* of same diameter as the surface 5*a* of the main winding drum 5, and its longitudinal one side edge 20*b* has a sharp blade configuration. At this side edge 20*b* a large number of hooks 22 are defined by a large number of U-shaped grooves 23 formed on the rear side of the hook blade 20, which hooks 22 are arranged side by side at suitable ($\alpha$) intervals.

The hook blade 20 is mounted in the recess 21, with its surface 20*a* flush with the surface 5*a* of the main winding drum 5. When mounted to the main winding drum 5, the hook blade 20 is so arranged relative to the drum 5 that the edges of the hooks 22 extend along the edge 12*a* of the channel 12 in side by side relation and in rearward looking fashion in the direction of rotation of the drum 5.

In FIGS. 3 and 4, reference numeral 24 designates a machine screw hole for mounting the hook blade 20 to the main winding drum 5. The hook blade 20 is mounted in the recess 21, with a machine screw 25 received in the machine screw hole 24.

Constructed as above described, the web tail edge holding device of this embodiment functions in such a way that, as already explained, when the cutter blade 13 or rigid member of the web separator 11 plunges into the channel 12 of the main winding drum 5, the web 1 is forced into the channel 12 and is separated (severed) in the channel 12, as shown in FIGS. 5 and 6. In this embodiment, a pair of web pressers 15, 15 are disposed across the cutter blade 13 of the web separator 11. Therefore, the web 1 is forced into the channel 12 while the web 1 is pressed by the pair of web pressers 15, 15 at both sides of its portion bridging the channel 12. In this case, the tail edge 1*b* portion of the web 1 is positively pressed at its portion adjoining the hooks against the hooks 22.

What is claimed is:

1. In a web winding apparatus including a main winding drum and a web separator roll which are operatively interconnected to rotate in synchronism, the main winding drum having a channel in the surface thereof, the web separator roll having web separator means projecting from the surface thereof for separating a web held against the surface of the main winding drum in the channel, the channel and the web separator means being so formed in the main winding drum and the web separator roll respectively that at selected times during synchronous rotation of the main winding drum and the separator roll the web separator means is forced into the channel, the web separator means having a rigid member which forces the web into the channel such that when the rigid member is forced into the channel, the web separator means will move the web into the channel so as to tear the web in the channel, a subsidiary winding drum and a nip roll disposed near said main winding drum, said main winding drum, said subsidiary winding drum and said nip roll being constructed and arranged so as to define a winding space for winding a web upon a core which has been fed into the winding space through a gap between said main winding drum and said subsidiary winding drum until a log of a desired diameter is obtained, said main winding drum having a separated-web tail edge holding device for holding the tail edge of the separated-web adjacent the channel and in contact with the surface of the main winding drum after the web separation takes place, said separated-web tail edge holding device comprising: a recess formed in the surface of the main winding drum extending in the direction of rotation along the leading edge of the channel of the main winding drum and in continuation to the channel, a hook blade assembly mounted in said recess, said hook blade assembly having an arcuate surface of same diameter as the surface of the main winding drum, the arcuate surface of said hook blade assembly being flush with the surface of the main winding drum, said hook blade assembly having a large number of hooks on a longitudinal edge which confronts the channel so as to hold the tail edge of the web on said large number of hooks after the web separation takes place.

2. The apparatus of claim 1 wherein said hook blade assembly has a sharp blade configuration on said longitudinal edge which faces the channel, said sharp blade configuration being defined by said arcuate surface of said hook blade assembly and a part of a back portion of the hook blade assembly, said hooks being defined by a plurality of U-shaped grooves formed on said back portion of said hook blade assembly so as for the hooks to be arranged side by side at predetermined intervals.

* * * * *